US008801173B2

(12) United States Patent
Ode

(10) Patent No.: US 8,801,173 B2
(45) Date of Patent: Aug. 12, 2014

(54) SHEET-DISCHARGE DEVICE AND IMAGE RECORDING APPARATUS EQUIPPED WITH THE SHEET-DISCHARGE DEVICE

(71) Applicant: Yasuhito Ode, Anjo (JP)

(72) Inventor: Yasuhito Ode, Anjo (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/039,799

(22) Filed: Sep. 27, 2013

(65) Prior Publication Data

US 2014/0092161 A1 Apr. 3, 2014

(30) Foreign Application Priority Data

Sep. 28, 2012 (JP) ..... 2012-217470

(51) Int. Cl.
*B41J 2/15* (2006.01)

(52) U.S. Cl.
USPC ..... 347/104; 347/17; 271/209; 271/294

(58) Field of Classification Search
USPC ..... 347/5, 9, 17, 104; 271/209, 294
See application file for complete search history.

(56) References Cited

U.S. PATENT DOCUMENTS 5,419,548 A * 5/1995 Ueda et al. ..... 271/294
5,709,382 A * 1/1998 Shima ..... 271/209
6,652,091 B2 * 11/2003 Tanno ..... 347/104

FOREIGN PATENT DOCUMENTS

JP 2002-274740 A 9/2002
JP 2005-314032 A 11/2005

* cited by examiner

*Primary Examiner* — Lam S Nguyen
(74) *Attorney, Agent, or Firm* — Merchant & Gould PC

(57) ABSTRACT

A sheet-discharge device, including: a sheet-discharge mechanism having a discharge opening from which a sheet is discharged in a discharge direction; a stopper having a hitting portion against which a leading edge, in the discharge direction, of the discharged sheet hits, so that the sheet is bounced back; a discharge tray having a support surface on which the sheet bounced back by the stopper is supported; and a sheet-discharge controller configured to control the sheet-discharge mechanism such that the discharged sheet flies above the support surface, wherein the hitting portion is provided at a position where a one-side portion of the leading edge first hits the hitting portion, the one-side portion of the leading edge being nearer to a one-side end of the sheet than a center of the leading edge in an orthogonal direction parallel to a horizontal plane and orthogonal to the discharge direction.

8 Claims, 10 Drawing Sheets

1
61
C
82
81
83
80
70
71a
71
71b
P
P1
P2
84
D,E
H1
H2
SUB SCANNING DIRECTION
MAIN SCANNING DIRECTION 1
61
C
82
P2
84
81
83
80
D,E
71a
70
71
71b
P
P1
H3
H4
SUB SCANNING DIRECTION
MAIN SCANNING DIRECTION 1
61
C
82
81
83
84
80
P2
P1
P
71a
71
71b
70
D.E
H5
H6
L
θ
SUB SCANNING DIRECTION
MAIN SCANNING DIRECTION

SHEET-DISCHARGE DEVICE AND IMAGE RECORDING APPARATUS EQUIPPED WITH THE SHEET-DISCHARGE DEVICE

CROSS REFERENCE TO RELATED APPLICATION

The present application claims priority from Japanese Patent Application No. 2012-217470, which was filed on Sep. 28, 2012, the disclosure of which is herein incorporated by reference in its entirety.

BACKGROUND OF THE INVENTION

1. Field of the Invention

The present invention relates to a sheet-discharge device and an image recording apparatus equipped with the sheet-discharge device.

2. Description of Related Art

There is known a sheet-discharge device having: an end face (as a stopper) against which a discharged sheet hits, so that the sheet drops downward on a support surface of a discharge table (discharge tray); and side fences configured to adjust a width of the discharge tray in accordance with a width of the sheet, so as to align sheets stacked on the support surface of the discharge table with respect to the width direction of the sheets.

SUMMARY OF THE INVENTION

In the above-indicated device, however, where the width of the discharge tray is not adjusted by the side fences for the purpose of discharging recording media in different sizes to the discharge tray, there may be a risk of poor alignment, in the width direction, of the sheets to be stacked on the discharge tray. In other words, when a leading edge of the discharged sheet hits on the end face and the sheet is bounced back by the end face, the sheet may be moved randomly in one or the other of widthwise opposite directions of the discharge tray, so that the sheets may not be properly aligned in the width direction thereof on the discharge tray.

It is therefore a first object of the invention to provide a sheet-discharge device that ensures, with higher reliability, proper alignment of sheets when stacked. It is a second object of the invention to provide an image recording apparatus equipped with the sheet-discharge device.

The above-indicated first object of the invention may be attained according to a first aspect of the invention, which provides a sheet-discharge device, comprising: a sheet-discharge mechanism having a discharge opening and configured to discharge a sheet from the discharge opening in a discharge direction that intersects a vertical direction by permitting the sheet to fly; a stopper having a hitting portion against which a leading edge, in the discharge direction, of the sheet discharged from the discharge opening hits, so that the sheet is bounced back; a discharge tray having a support surface on which the sheet bounced back by the stopper is supported, the discharge tray being disposed, between the discharge opening and the stopper, at a height level in the vertical direction lower than a height level of the hitting portion of the stopper; and a sheet-discharge controller configured to control the sheet-discharge mechanism such that the sheet discharged from the discharge opening flies above the support surface, wherein the hitting portion is provided at a position at which a one-side portion of the leading edge of the sheet first hits the hitting portion, the one-side portion of the leading edge being nearer to a one-side end of the sheet than a center of the leading edge in an orthogonal direction that is parallel to a horizontal plane and that is orthogonal to the discharge direction.

The above-indicated second object of the invention may be attained according to a second aspect of the invention, which provides an image recording apparatus, comprising: the sheet-discharge device described above; a recording portion configured to record an image on the sheet based on a recording command before the sheet is discharged from the discharge opening by the sheet-discharge mechanism; and a stopper-pivoting controller configured to control the stopper pivoting mechanism to pivot the stopper from the first position to the second position or from the second position to the first position, such that, where a new recording command is received, at least one sheet on which an image has been recorded based on the new recording command is stacked on sheets already discharged to the discharge tray at a position different from a position of an uppermost one of the sheets.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which:

FIG. 3A shows a state in which a stopper is placed at a first position and FIG. 3B shows a state in which the stopper is placed at a second position;

DETAILED DESCRIPTION OF EMBODIMENT

There will be explained one embodiment of the present invention with reference to the drawings.

Figure 1:
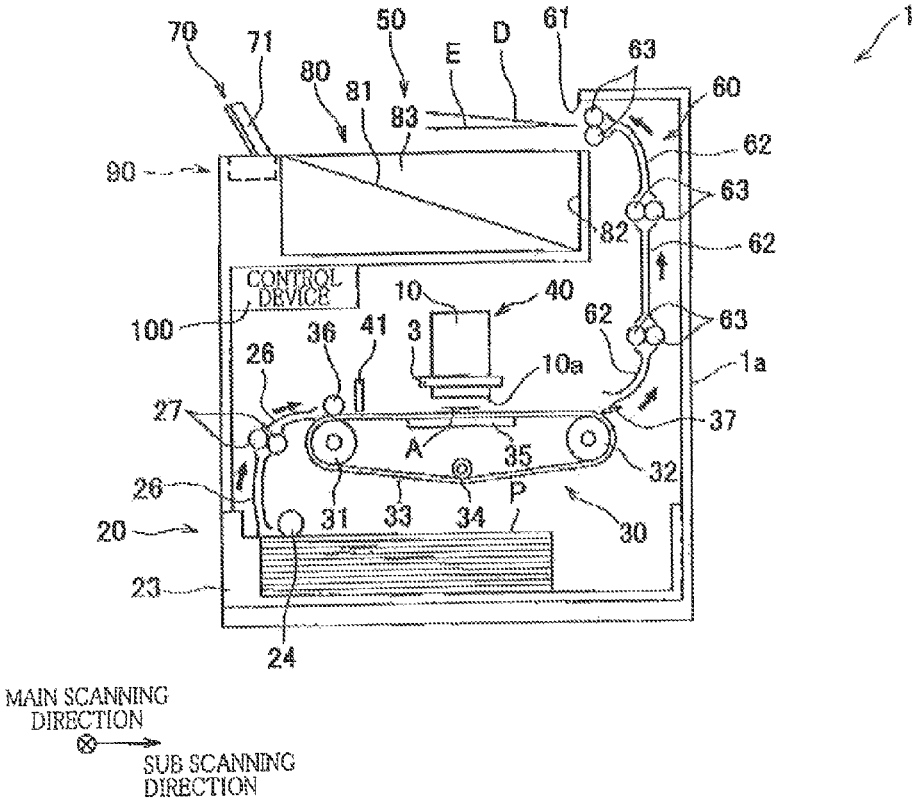
FIG. 1 is a side view schematically showing an overall structure of an ink-jet printer according to one embodiment of the present invention.

Referring first to FIG. 1, there will be explained an overall structure of an image recording apparatus equipped with a sheet-discharge device according to one embodiment of the invention. In the present embodiment, the image recording apparatus is an ink-jet printer 1 configured to record an image on a sheet P by ejecting ink thereto. The printer 1 has: a recording portion 40 configured to record an image on a sheet P by attaching ink thereto, a conveyance mechanism 30 configured to convey the sheet P such that the sheet P passes right below the recording portion 40; a sheet-supply device 20 configured to supply the sheet P to the conveyance mechanism 30; and a sheet-discharge device 50 configured to discharge the sheet P on which an image has been recorded by the recording portion 40.

The printer 1 has a housing 1 having a rectangular parallelepiped shape. In a space defined by the housing 1*a*, there is formed a sheet conveyance path through which the sheet P is conveyed along bold arrows in FIG. 1 from a sheet-supply tray 23 toward a discharge opening 61 that will be explained.

In the housing 1*a*, there are accommodated the recording portion 40, the sheet-supply device 20, the conveyance mechanism 30, a discharge mechanism 60 of the sheet-discharge device 50, a control device 100 configured to control operations of various portions of the printer 1, and so on. Further, on a top plate of the housing 1*a*, there are provided a stopper 70, a discharge tray 80, and a stopper pivoting mechanism 90 that constitute the sheet-discharge device 50.

The recording portion 40 has an ink jet head 10 (hereinafter simply referred to as "head 10") and a cartridge (not shown) in which is stored black ink to be supplied to the head 10. The cartridge is connected to the head 10 via a tube and a pump (both not shown).

The head 10 is a line head that is fixedly positioned at a prescribed location and has a substantially rectangular parallelepiped shape that is long in a main scanning direction. The lower surface of the head 10 is an ejection surface 10*a* in which a multiplicity of ejection openings are open. In an image recording operation, the black ink is ejected from the ejection openings. The head 10 is supported with respect to the housing 1*a* via a head holder 3. The head holder 3 holds the head 1 such that a prescribed clearance suitable for recording is formed between the ejection surface 10*a* and an upper surface of a conveyor belt 33 that will be explained. Here, a sub scanning direction is a direction that is parallel to a conveyance direction (indicated by an arrow A in FIG. 1) in which the sheet P is conveyed by the conveyance mechanism 30 and that is parallel to the horizontal direction. The main scanning direction is a direction that is parallel to the horizontal plane and that is orthogonal to the sub scanning direction.

The conveyance mechanism 30 has two belt rollers 31, 32, the conveyor belt 33, a tension roller 34, a platen 35, a nip roller 36, and a peeling plate 37. The conveyor belt 33 is an endless bet looped around the two rollers 31, 32 and is subject to tension applied from the tension roller 34. The outer circumferential surface of the conveyor belt 33 is a conveyor surface on which is formed a silicone layer, i.e., a low-tack cover layer covering the outer circumferential surface. The sheet P is held on the conveyor surface when conveyed. The platen 35 is disposed so as to be opposed to the head 10 and supports an upper portion of a loop of the conveyor belt 33 from an inside of the loop. The belt roller 32 is a drive roller configured to move the conveyor belt 33. The belt roller 32 is rotated clockwise in FIG. 1 by a motor not shown. The belt roller 31 is a driven roller configured to be rotated by the movement of the conveyor belt 33. The nip roller 36 is configured to press the sheet P conveyed from the sheet-supply device 20, onto the conveyor surface of the conveyor belt 33. The peeling plate 37 is configured to peel off the sheet P from the conveyor belt 33 and to guide the sheet P toward the discharge mechanism 60.

The sheet-supply device 20 has the sheet-supply tray 23, a sheet-supply roller 24, two guides 26, and a feed-roller pair 27. The sheet-supply tray 23 is a box opening upward, and a stack of the sheet P can be accommodated therein. The two guides 26 connect the sheet-supply tray 23 and the conveyance mechanism 30. The sheet-supply roller 24 is configured to rotate under control of the control device 100 so as to supply an uppermost one of the sheets P accommodated in the sheet-supply tray 23. The feed-roller pair 27 is configured to rotate under control of the control device 100 so as to feed the sheet P supplied from the sheet-supply roller 24 to the conveyance mechanism 30.

The sheet-discharge device 50 will be next explained in detail. The sheet-discharge device 50 has the discharge mechanism 60, the stopper 70, the discharge tray 80, the stopper pivoting mechanism 90, and a sheet-discharge controller 150 (FIG. 6) configured to control various portions of the sheet-discharge device 50. The sheet-discharge controller 150 is one functional portion of the control device 100.

Figure 3B:
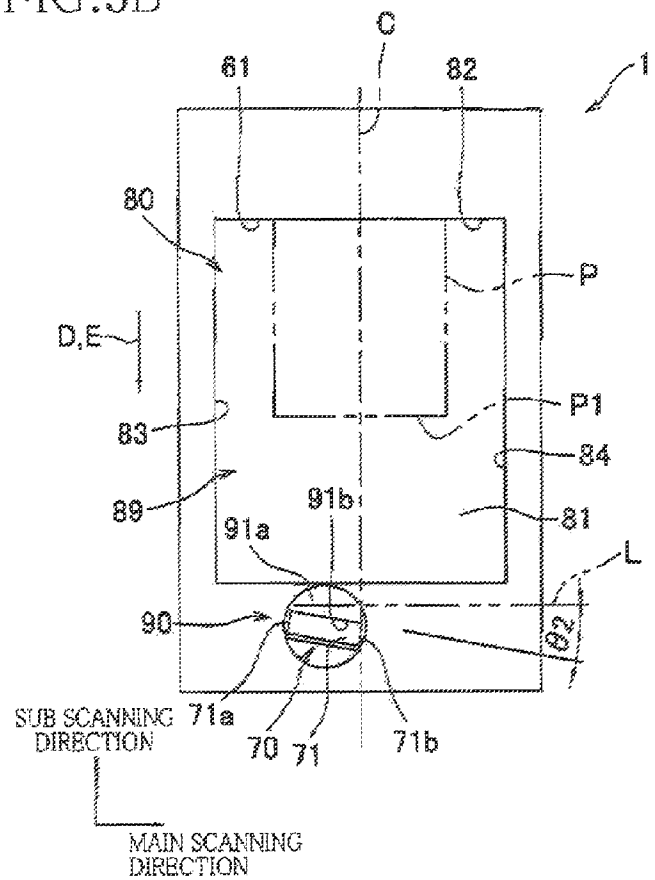
FIGS. 3A and 3B are plan views of the ink-jet printer shown in FIG. 1, more specifically.

The discharge mechanism 60 has the discharge opening 61, three guides 62, and three transfer-roller pairs 63. The discharge opening 61 is provided at one of opposite ends, in the sub scanning direction, of the top plate of the housing 1*a*. The three guides 62 connect the conveyance mechanism 30 and the discharge opening 61. The rollers of the three transfer-roller pairs 63 are configured to rotate under control of the sheet-discharge controller 150 so as to discharge the sheet P conveyed from the conveyance mechanism 30 by permitting the sheet P to fly. More specifically, the sheet P is discharged from the discharge opening 61 such that the sheet P flies above a support surface 81 of the discharge tray 80 and hits on the stopper 70. On the support surface 81 of the discharge tray 80, there are stacked the sheets P discharged from the discharge opening 61. In this sense, the support surface 81 may be referred to as a sheet stack surface. The sheet P is discharged from the discharge opening 61 such that a center of the sheet P in the main scanning direction overlaps a centerline C that passes a center of the discharge opening 61 in the main scanning direction, as shown by the long dashed double-short dashed line in FIG. 3. In the most downstream one of the three transfer-roller pairs 63 in the conveyance direction of the sheet P, a straight line connecting two rotation axes of the respective two rollers intersects the horizontal plane, in other words, the two rotation axes are arranged in the vertical direction, such that a discharge direction D of the sheet P discharged from the discharge mechanism 60 intersects the vertical direction.

Figure 2:
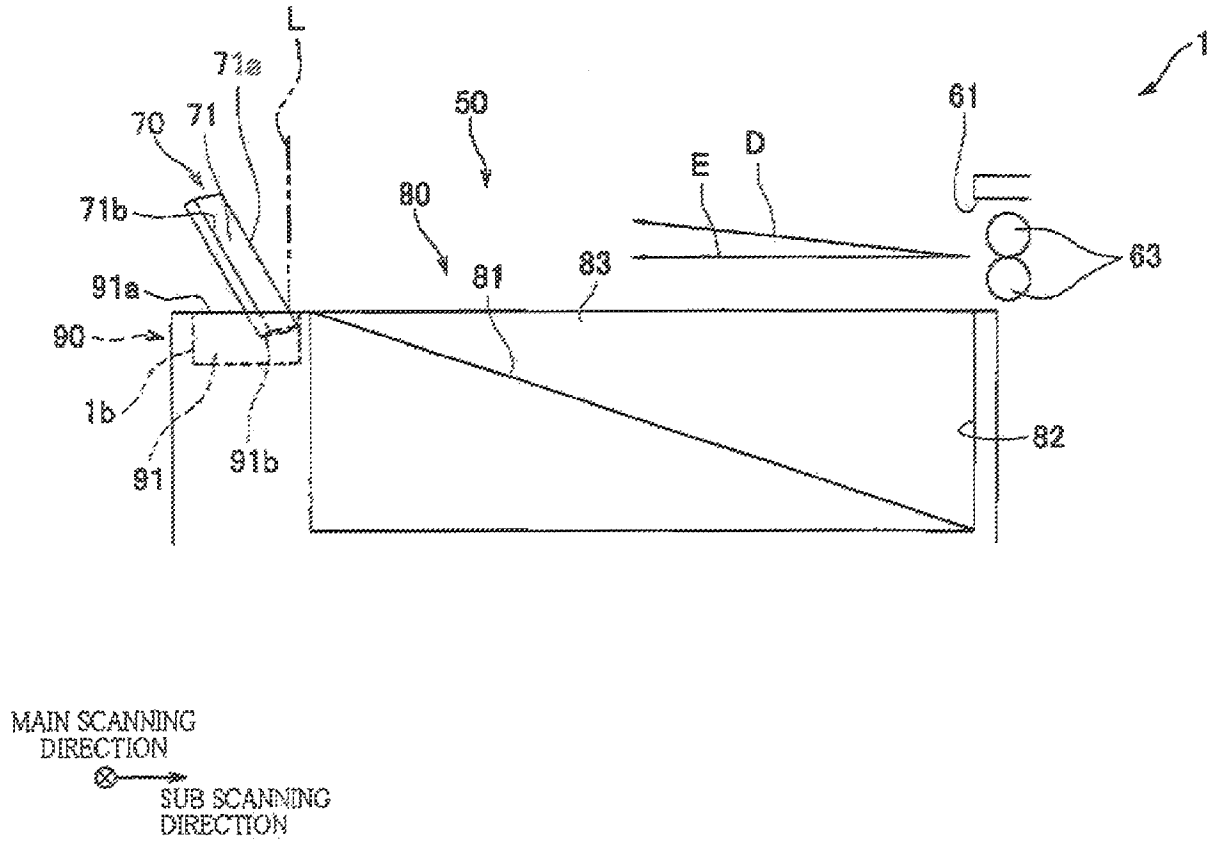
FIG. 2 is a side view of a sheet-discharge device shown in FIG. 1.

The stopper 70 is a flat plate member having a rectangular shape. The stopper 71 is provided at the other of the opposite ends, in the sub scanning direction, of the top plate of the housing 1*a*, so as to be opposed to the discharge opening 61. As shown in FIG. 2, the stopper 70 is supported, at its lower end portion, by the stopper pivoting mechanism 90 provided at the top plate of the housing 1*a*, so as to extend upward therefrom. As shown in FIG. 3, the stopper 70 is disposed on a left side of the centerline C in the main scanning direction.

Figure 3A:
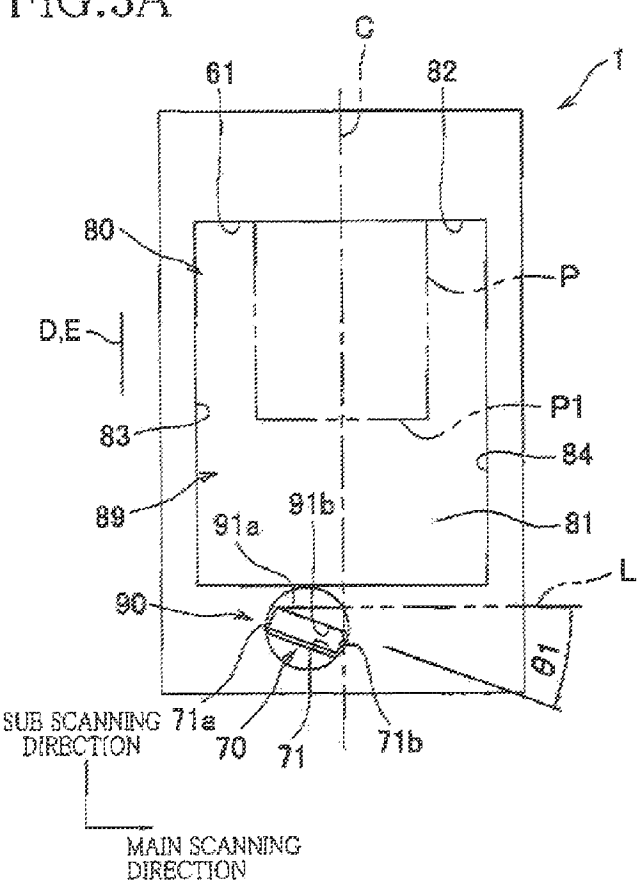

The stopper 70 has a flat hitting surface (hitting portion) 71 against which the sheet P discharged from the discharge opening 61 by the discharge mechanism 60 hits. The hitting surface 71 is disposed on one of opposite sides of the stopper 70 that is nearer to the discharge opening 61 in a direction E of a horizontal component of the discharge direction D. (Hereinafter, the direction E of the horizontal component of the discharge direction D will be simply referred to as "horizontal-component direction E" where appropriate). To be more specific, the hitting surface 71 of the stopper 70 is formed such that a direction away from the stopper 70 along a normal line of the hitting surface 71 has a component toward the discharge opening 61. Further, as shown in FIG. 3A, the hitting surface 71 is formed such that a left end 71*a* of the hitting surface 71 is located nearer to the discharge opening 61 than a right end 71*b* of the hitting surface 71 in the horizontal-component direction E. Here, the left end 71*a* is a one-side end of the hitting surface 71 in the main scanning direction, i.e., in an orthogonal direction that is parallel to the horizontal plane and that is orthogonal to the discharge direction D while the right end 71*b* is an other-side end of the hitting surface 71 that is opposite to the left end 71*a* in the main scanning direction (the orthogonal direction). The thus formed hitting surface 71 is provided at a position at which a left-side portion in FIG. 3 (as a one-side portion) of a leading edge P1, in the discharge direction D, of the sheet P discharged from the discharge opening 61 first hits on the hitting surface 71. Here, the leading edge of the sheet P is one of four edges of the sheet P that first comes out of the discharge opening 61 among the four edges and that extends in the main scanning direction. Further, the left-side portion (the one-side portion) of the leading edge P1 is located nearer to a left-side end (as a one-side end) of the sheet P in the main scanning direction (the orthogonal direction) than the center of the leading edge P1 in the main scanning direction (the orthogonal direction). Further, as shown in FIGS. 2 and 3, the hitting surface 71 is inclined in the discharge direction D relative to a vertical plane L that includes the main scanning direction therein, in other words, the vertical plane L that is parallel to the main scanning direction (the orthogonal direction), such that a distance, in the horizontal-component direction E, between an upper end of the hitting surface 71 and the discharge opening 61 is larger than a distance, in the horizontal-component direction E, between a lower end of the hitting surface 71 and the discharge opening 61.

The discharge tray 80 has the support surface 81 on which the sheet P discharged from the discharge opening 61 and bounced back by the stopper 70 is supported or stacked. The discharge tray 80 is disposed, between the discharge opening 61 and the stopper 70, at a height level in the vertical direction lower than a height level of the hitting surface 71 of the stopper 70. As shown in FIGS. 2 and 3, the discharge tray 80 has three wall portions 82, 83, 84 that cooperate with the support surface 81 to define a recess 89 in which the discharged sheet P is accommodated. The wall portion 82 (as one example of a first wall portion) extends upward from an edge or end of the support surface 81 located near to the discharge opening 61 in the horizontal-component direction E. The wall portion 83 extends upward from a left-side edge or end (in FIG. 3) of the support surface 81 in the main scanning direction. The left-side edge or end of the support surface 81 is located near to the left-side end (the one-side end) of the sheet P. The wall portion 84 (as one example of a second wall portion) extends upward from a right-side edge or end (in FIG. 3) of the support surface 81 in the main scanning direction. The right-side edge or end of the support surface 81 is located near to a right-side end (as an other-side end) of the sheet P in the main scanning direction. As apparent from FIG. 3, the left-side end (the one-side end) and the right-side end the other-side end) of the sheet P are opposite to each other in the main scanning direction (the orthogonal direction). As shown in FIG. 3, the support surface 81 has a plane size, as viewed in the vertical direction, larger than that of the sheet P. Accordingly, a distance, in the main scanning direction, between the wall portion 83 and the wall portion 84 is larger than a width, in the main scanning direction, of the sheet P.

As shown in FIG. 2, the stopper pivoting mechanism 90 has a pivot portion 91 and a motor (not shown) configured to pivot the pivot portion 91. The pivot portion 91 is disposed in a hole 1*b* formed in the top plate of the housing 1*a*, and an upper surface 91*a* of the pivot portion 91 is flush with the top plate. A hole 91*b* is formed in the upper surface 91*a* of the pivot portion 91. The lower end portion of the stopper 70 is inserted in the hole 91*b*, such that the stopper 70 is supported by the pivot portion 91.

The pivot portion 91 is configured to pivot about an axis parallel to the vertical direction by the motor driven under control of the sheet-discharge controller 150. The pivot portion 91 pivots such that the stopper 70 is selectively placed at one of a first position (a first posture) and a second position (a second posture). The first position of the stopper 70 is a position shown in FIG. 3A at which the hitting surface 71 and the vertical plane L that is parallel to the main scanning direction define a prescribed angle θ1. The second position of the stopper 70 is a position shown in FIG. 3B at which the left end 71*a* of the hitting surface 71 is located more distant in the horizontal-component direction E from the discharge opening 61 than the left end 71*a* of the stopper 70 placed at the first position and at which the hitting surface 71 and the vertical plane L defines a prescribed angle θ2. The angle θ1 is larger than the angle θ2.

Referring next to FIGS. 4A-4E, there will be explained a movement of the sheet P discharged when the stopper 70 is placed at the first position.

Figures 4A, 4B, 4C, 4D, 4E:
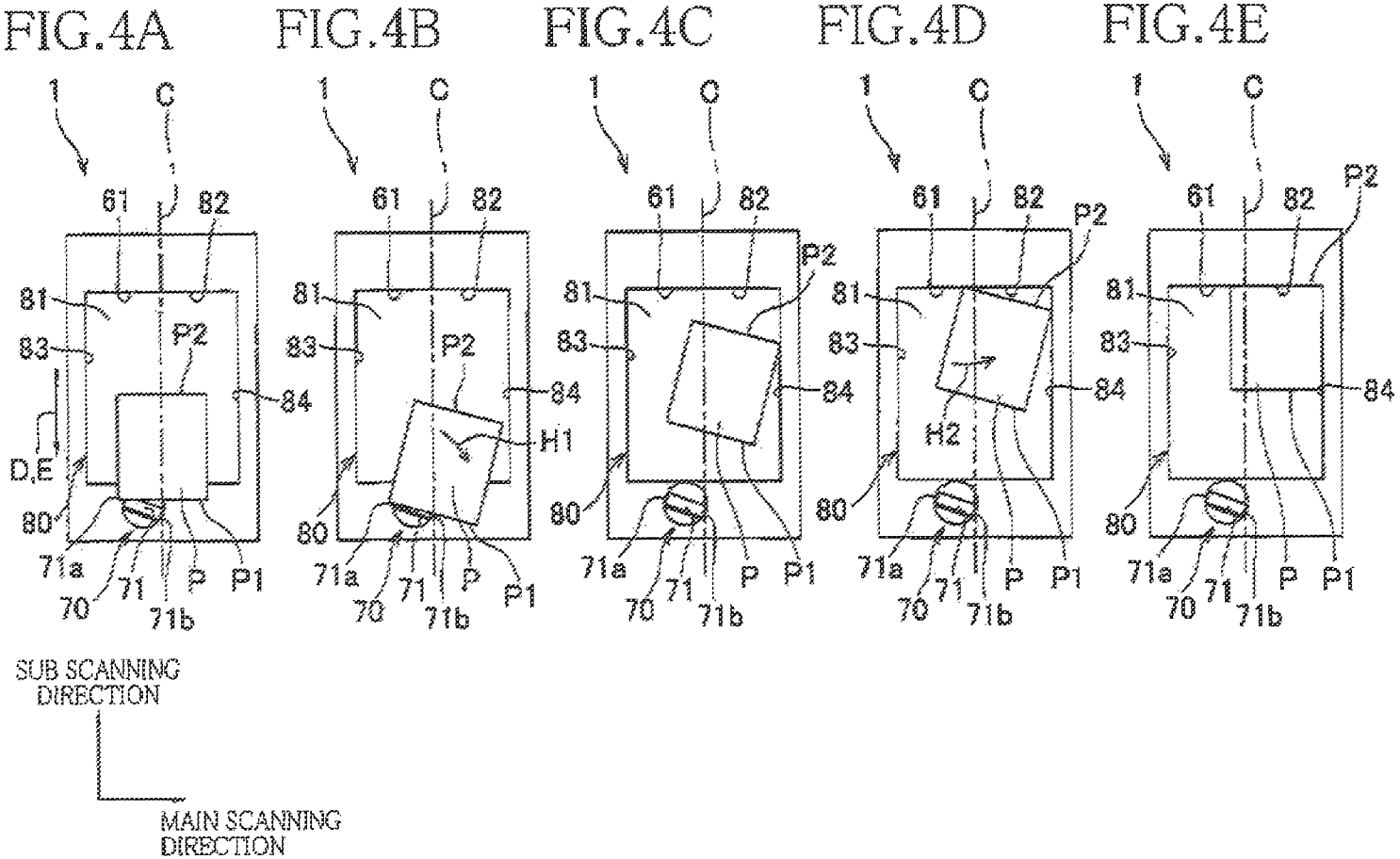
FIGS. 4A-4E show a movement of a sheet when discharged from a discharge opening in the state in which the stopper is placed at the first position.

As shown in FIG. 4A, when the sheet P is discharged from the discharge opening 61, the leading edge P1 of the discharged sheet P hits on the stopper 70. To be more specific, the leading edge P1 hits on the left end 71*a* of the hitting surface 71 at its left-side portion (the one-side portion) that is nearer to the left-side end of the sheet P than the center of the leading edge P1 in the main scanning direction. In this instance, because the hitting surface 71 is inclined in the discharge direction D such that the upper end of the hitting surface 71 is away from the ejection opening 61, the leading edge P1 of the sheet P slightly moves in the discharge direction D along the hitting surface 71 while the speed of the movement of the sheet P in the discharge direction D is reduced, in other words, the momentum of the sheet P in the discharge direction D is weakened, due to the hitting on the stopper 70. In this movement, a trailing edge P2 of the sheet P drops down toward the support surface 81. As a result, a space between a rear portion, of the sheet P on the side of the trailing edge P2 (i.e., a portion of the sheet P near to the trailing edge P2) and the support surface 81 is reduced. The arrangement ensures proper alignment of the sheets P with higher reliability, as compared with an arrangement in which the trailing edge P2 starts to drop downward after the sheet P has taken a prescribed proper posture. Further, in this instance, the sheet P rotates about a hitting point of the sheet P and the stopper 70 in a direction indicated by an arrow H1 in FIG. 4B due to the hitting of the sheet P and the hitting surface 71.

Subsequently, as shown in FIG. 4C, the sheet P slips down toward the wall portion 82 along the hitting surface 71 and the support surface 81 before a right-side end (as an other-side end located at the other-side end of the sheet P), in the main scanning direction or the orthogonal direction, of the trailing edge P2, in the discharge direction D, of the sheet P hits on the wall portion 84. Because the sheet P has rotated in the direction H1 in this instance, the right-side end of the trailing edge P2 comes into contact with the wall portion 84 while the sheet P slips down on the support surface 81. Thereafter, the sheet P moves, as shown in FIG. 4D, such that a left-side end (as a one-side end located at the one-side end of the sheet P), in the main scanning direction or the orthogonal direction, of the trailing edge P2 hits on the wall portion 82 while the right-side end of the trailing edge P2 moves along the wall portion 84. Due to the hitting, the sheet P rotates about a hitting point of the left-side end of the trailing edge P2 and the wall portion 82 in a direction indicated by an arrow H2 in FIG. 4D. As a result, the sheet P is stacked on the support surface 81 with the entirety of a right-side edge of the sheet P kept in contact with the wall portion 84, as shown in FIG. 4E.

In the present embodiment, the stopper 70 placed at the first position is configured such that the right-side end of the trailing edge P2 does not come into contact with the wall portion 84 before the sheet P that has hit on the hitting surface 71 moves away from the hitting surface 71. The stopper 70 placed at the first position may be configured such that the right-side end of the trailing edge P2 comes into contact with the wall portion 84 before the sheet P that has hit on the hitting surface 71 moves away from the hitting surface 71.

Referring next to FIGS. 5A-5D, there will be explained a movement of the sheet P discharged when the stopper 70 is placed at the second position.

Figures 5A, 5B, 5C, 5D:
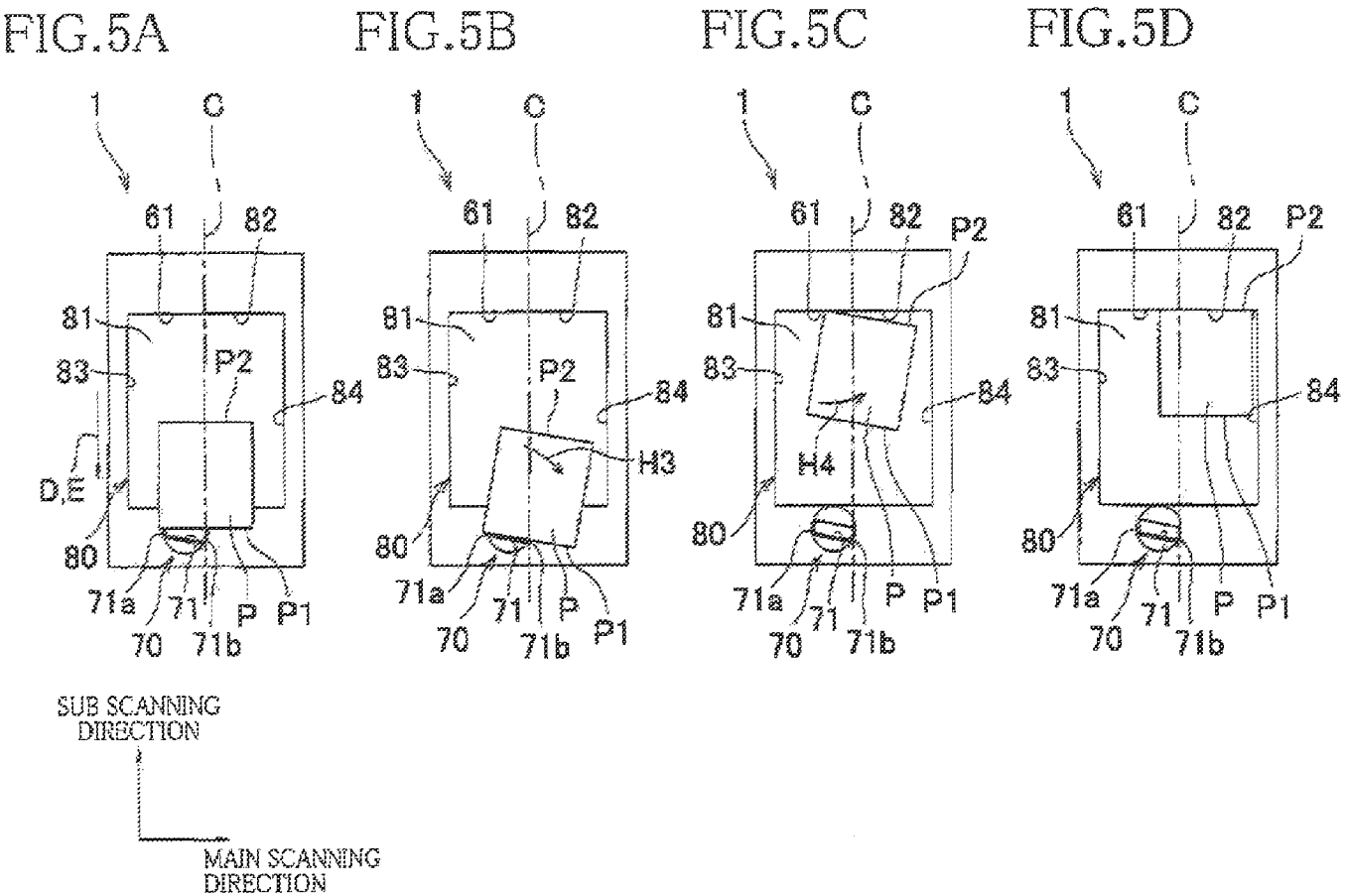
FIGS. 5A-5D show a movement of a sheet when discharged from the discharge opening in the state in which the stopper is placed at the second position.

When the sheet P is discharged from the discharge opening 61, the leading edge P1 of the discharged sheet P hits on the stopper 70, as shown in FIG. 5A. In this instance, the leading edge P1 hits on the left end 71*a* of the hitting surface 71 at its left-side portion (the one-side portion) that is nearer to the left-side end of the sheet P than the center of the leading edge P1 in the main scanning direction, as in the above-indicated case in which the stopper 70 is placed at the first position. Also in this instance, because the hitting surface 71 is inclined in the discharge direction D such that the upper end of the hitting surface 71 is away from the ejection opening 61, the leading edge P1 of the sheet P slightly moves in the discharge direction D along the hitting surface 71 while the speed of the movement of the sheet P toward the discharge direction D is reduced, in other words, the momentum of the sheet P toward the discharge direction D is weakened, due to the hitting on the stopper 70. As in the above-indicated case, the trailing edge P2 of the sheet P drops down in the movement, so that proper alignment of the sheets P is ensured. Further, in this instance, the sheet P rotates about a hitting point of the sheet P and the stopper 70 in a direction indicated by an arrow H3 in FIG. 5B due to the hitting of the sheet P and the hitting surface 71.

Subsequently, as shown in FIG. 5C, the sheet P slips down toward the wall portion 82 along the hitting surface 71 and the support surface 81. Because the sheet P has rotated in the direction H3, the sheet P slips down on the support surface 81 such that the right-side end of the trailing edge P2 gets closer to the wall portion 84. Thereafter, the sheet P moves such that the left-side end of the trailing edge P2 hits on the wall portion 82 before the right-side end of the trailing edge P2 hits on the wall portion 84. Due to the hitting, the sheet P rotates about a hitting point of the left-side end of the trailing edge P2 and the wall portion 82 in a direction indicated by an arrow H4 in FIG. 5C. As a result, the sheet P is stacked on the support surface 81 with the entirety of the right-side edge of the sheet P located near to the wall portion 84, as shown in FIG. 5D. Because the angle θ2 of the hitting surface 71 when the stopper 71 is placed at the second position is smaller than the angle θ1 of the hitting surface 71 when the stopper 71 is placed at the first position, the sheet P that has hit on the stopper 70 placed at the second position does not move toward the wall portion 84 to such an extent that the entirety of the right-side edge of the sheet P contacts the wall portion 84. However, every sheet P that has hit on the stopper 70 placed at the second position similarly moves rightward, so that a variation in positions of the sheets P in the main scanning direction when stacked is reduced, resulting in improved alignment of the sheets P.

On the other hand, every sheet P that has hit on the stopper 70 placed at the first position move toward the wall portion 84 to such an extent that the entirety of the right-side edge of each sheet P contacts the wall portion 84, resulting in improved alignment of the sheets P.

Figure 6:
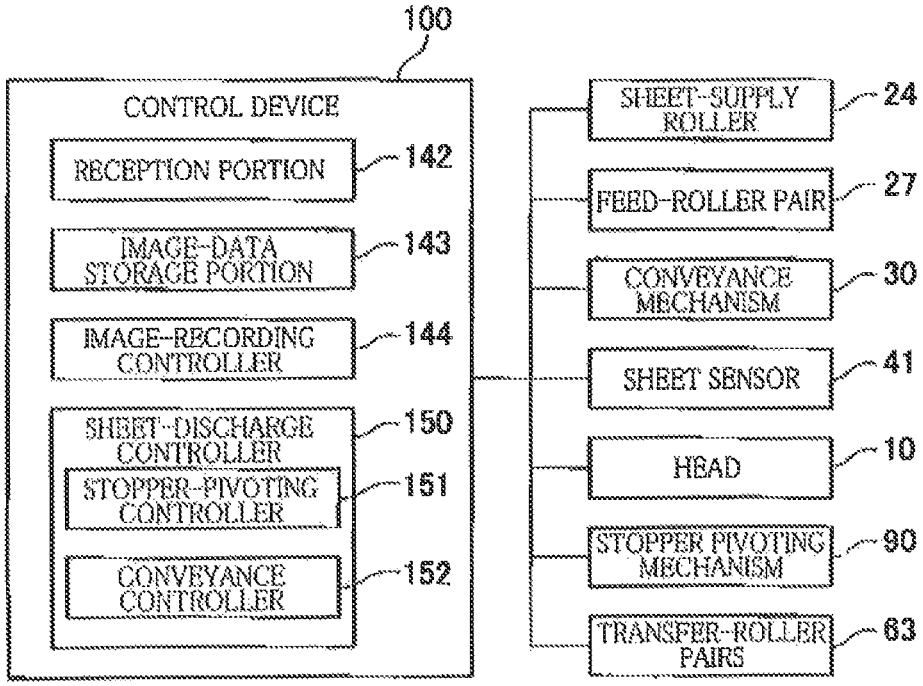
FIG. 6 is a block diagram showing an electric structure of a control device shown in FIG. 1.

Referring next to FIG. 6, the control device 100 will be explained in detail. The control device 100 includes a Central Processing Unit (CPU), a Read Only Memory (ROM) which stores programs to be executed by the CPU and which rewritably stores data to be utilized in the programs, and a Random Access Memory (RAM) in which data is temporarily stored when the programs are executed. Various functional portions that constitute the control device 100 are established by corporation of the hardware indicated above and software in the ROM. As shown in FIG. 6, the control device 100 includes a reception portion 142, an image-data storage portion 143, an image-recording controller 144, and a sheet-discharge controller 150, each as the functional portion.

The reception portion 142 is configured to receive a recording command transmitted from an external device (such as a PC or the like connected to the printer 1). The image-data storage portion 143 is configured to store image data based on which an image is to be recorded on the sheet P.

The image-recording controller 144 is configured to perform an image recording operation on the sheet P on the basis of the recording command received by the reception portion 142. More specifically, the image-recording controller 144 is configured to control the sheet-supply roller 24, the feed-roller pair 27, and the conveyance mechanism 30 such that the sheet is supplied from the sheet-supply tray 23 and the supplied sheet P passes right below the ejection surface 10*a*. Further, the image-recording controller 144 is configured to control the head 10 to eject the ink from the ejection openings such that an image based on the image data stored in the image-data storage portion 143 is recorded on the sheet P conveyed by the conveyance mechanism 30 right below the ejection surface 10*a*. This ink ejection operation is performed at timing synchronized with conveyance of the sheet P, on the basis of a detection signal from a sheet sensor 41. The sheet sensor 41 is disposed between the nip roller 36 and the head 10 in the conveyance direction A and is configured to detect a leading end of the sheet P.

The sheet-discharge controller 150 is configured to control the transfer-roller pairs 63 and the stopper pivoting mechanism 90 such that the sheet P on which the image has been recorded under control of the image-recording controller 144 is discharged onto the support surface 81 of the discharge tray 80 so as to be stacked thereon. The sheet-discharge controller 150 includes a stopper-pivoting controller 151 and a conveyance controller 152.

The stopper-pivoting controller 151 is configured to control the stopper pivoting mechanism 90 such that, where the reception portion 142 receives a new recording command, the stopper 70 that is being placed at the first position is placed at the second position only when an initial sheet P on which an image based on the new recording command has been initially recorded is discharged from the discharge opening 61. According to the arrangement, the initial sheet P on which the image based on the new recording command has been initially recorded is stacked on an uppermost one of the sheets P that are already discharged to the discharge tray 80 and placed on the support surface 81, such that the initial sheet P is shifted, in the main scanning direction, relative to the uppermost sheet.

The conveyance controller 152 is configured to control the transfer-roller pairs 63 such that the sheet P is discharged from the discharge opening 61 at a prescribed discharge speed. The prescribed discharge speed is set to a speed that enables the sheet P discharged from, the discharge opening 61 to fly above the support surface 81 so as to hit on the stopper 70.

Figure 7:
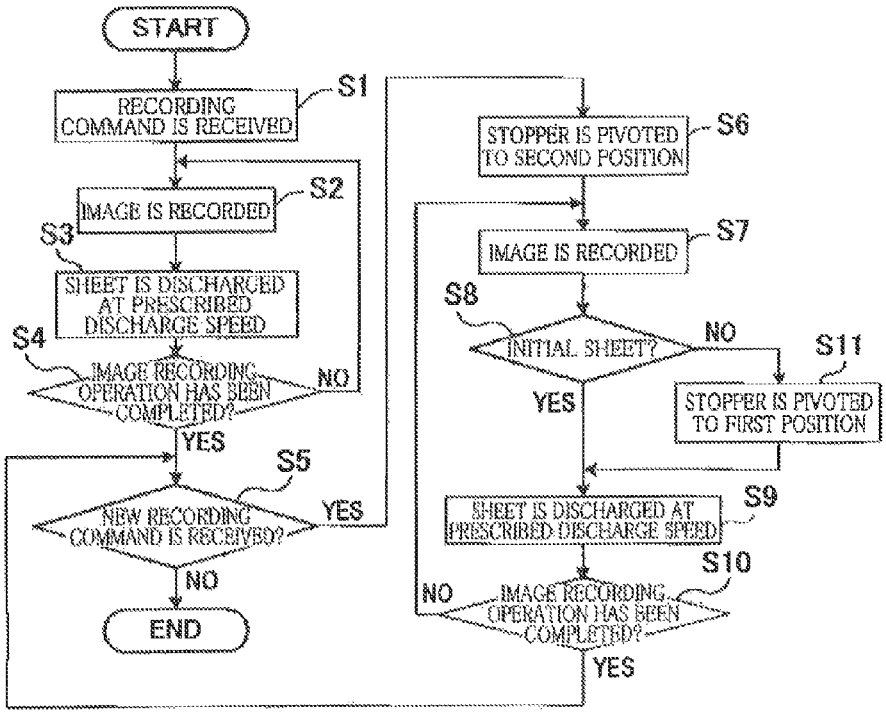
FIG. 7 is a flow chart showing an operation of the ink jet printer shown in FIG. 1.

Referring next to FIG. 7, there will be explained an operation of the printer 1 according to the present embodiment.

When the reception portion 142 receives a recording command from an external device (S1), the image-recording controller 144 controls the sheet-supply roller 24, the feed-roller pair 27, the conveyance mechanism 30, and the head 10 such that an image recording operation is performed on one sheet P on the basis of the recording command received by the reception portion 142 (S2). Subsequently, the conveyance controller 152 controls the transfer-roller pairs 63 such that the sheet P is discharged from the discharge opening 61 at the prescribed discharge speed (S3). The stopper 70 is normally placed at the first position under control of the stopper-pivoting controller 151. Accordingly, the sheet P discharged from the discharge opening 61 is stacked on the support surface 81 with the entirety of its right-side edge in FIG. 3 kept in contact with the wall portion 84 as described above.

Thereafter, the image-recording controller 144 judges whether or not the image recording operation based on the recording command received by the reception portion 142 has been completed for all of the sheets P each as a target of the image recording operation based on the current recording command (S4). Where it is judged that the image recording operation has been completed for all of the sheets P (S4: YES) and the reception portion 142 does not receive a new recording command (S5: NO), the present processing is ended.

On the other hand, where it is judged that the image recording operation has not been completed (S4: NO), the process returns back to step S2 and the image-recording controller 144 continuously controls the sheet-supply roller 24, the feed-roller pair 27, the conveyance mechanism 30, and the head 10 such that the image recording operation is performed on the sheet P on the basis of the recording command (S2). Subsequently, the conveyance controller 152 controls the transfer-roller pairs 63 such that the sheet P is discharged from the discharge opening 61 at the prescribed discharge speed (S3). It is noted that the control described above is repeatedly executed at a plurality of times corresponding to a number of the sheets P for one recording command. In this way, a plurality of sheets P discharged from the discharge opening 61 are stacked on the support surface 81 with the entirety of the right-side edge in FIG. 3 of each sheet P kept in contact with the wall portion 84.

Thereafter, where the reception portion 142 does not receive any new recording command at S5 (S5: NO), the present processing is ended. On the other hand, where the reception portion 142 receives a new recording command different from the preceding recording command (S5: YES), the stopper-pivoting controller 151 controls the stopper pivoting mechanism 90 such that the stopper 70 that is being placed at the first position is placed at the second position (S6). Subsequently, the image-recording controller 144 controls the sheet-supply roller 24, the feed-roller pair 27, the conveyance mechanism 30, and the head 10 such that the image recording operation is performed on one sheet P on the basis of the new recording command in question as a current command (S7). Thereafter, the stopper-pivoting controller 151 judges whether or not the sheet P on which the image recording operation has been performed on the basis of the current recording command is an initial sheet on which an image based on the current recording command has been initially recorded (S8). Where the sheet is the initial sheet P (S8: YES), the conveyance controller 152 controls the transfer-roller pairs 63 such that the sheet P is discharged from the discharge opening 61 at the prescribed discharge speed (S9). As a result, the sheet P is stacked on an uppermost one of the sheets P that are already discharged to the discharge tray 80 such that the entirety of the right-side edge in FIG. 3 of the sheet P discharged from the discharge opening 61 is located near to the wall portion 84 though the right-side edge of the sheet P does not contact the wall portion 84. Accordingly, the initial sheet P1 on which the image based on a new recording command has been initially recorded is stacked so as to be shifted, in the main scanning direction, from the uppermost one of the sheets P that are already discharged to the discharge tray 80.

Subsequently, the image-recording controller 144 judges whether or not the image recording operation based on the new recording command received by the reception portion 142 has been completed for all of the sheets P each as a target of the image recording operation based on the current recording command (S10). Where it is judged that the image recording operation has been completed for all of the sheets (S10: YES) and the reception portion 142 does not receive any new recording command (S5: NO), the present processing is ended.

On the other hand, where it is judged that the image recording operation has not been completed for all of the sheets (S10: NO), the process returns back to S7 and the image-recording controller 144 continuously controls the sheet-supply roller 24, the feed-roller pair 27, the conveyance mechanism 30, and the head 10 such that the image recording operation based on the current recording command is performed on the sheet P (S7). Subsequently, the stopper-pivoting controller 151 judges whether or not the sheet P on which the image recording operation has been performed on the basis of the current recording command is an initial sheet on which an image based on the current recording command has been initially recorded (S8). Where the sheet P is not the initial sheet P (S8: NO), the stopper-pivoting controller 151 controls the stopper pivoting mechanism 90 such that the stopper 70 that is being placed at the second position is placed at the first position (S11). Subsequently, the conveyance controller 152 controls the transfer-roller pairs 63 such that the sheet P is discharged from the discharge opening 61 at the prescribed discharge speed (S9). As a result, the sheet P discharged from the discharge opening 61 is stacked, on the sheet shifted as described above, with the entirety of its right-side edge in FIG. 3 kept in contact with the wall portion 84. According to the arrangement described above, only one initial sheet P on which an image based on a new recording command has been initially recorded is stacked so as to be shifted, in the main scanning direction, from an uppermost one of the sheets P that are already discharged to the discharge tray 80. Therefore, a user can easily recognize a set of the sheets P for every recording command.

Where the reception portion 142 does not receive any new recording command at S5 (S5: NO) after S10, the present processing is ended. On the other hand, where the reception portion 142 receives a new recording command at S5 (S5: YES) after S10, the processing described above is executed.

According to the present embodiment, the sheet P discharged from the discharge opening 61 is bounced back, more specifically, bounced back toward the discharge opening 61 by the stopper 70 and is stacked on the support surface 81 of the discharge tray 80. Here, the wording "back toward the discharge opening 61" not only means a direction exactly opposite to the discharge direction D, but also broadly includes any direction toward the discharge opening 61 that inclines relative to the direction exactly opposite to the discharge direction D. In this instance, the left-side portion (the one-side portion) of the leading edge P 1 of the sheet P first hits on the hitting surface 71 of the stopper 70. Accordingly, the sheet P bounced back by the stopper 70 moves rightward toward the wall portion 84. Thus, the sheets P discharged from the discharge opening 61 similarly move rightward, so that a variation in positions of the sheets P in the main scanning direction when stacked is reduced, resulting in improved alignment of the sheets P.

The hitting surface 71 of the stopper 70 is formed such that the left end 71*a* is located nearer to the discharge opening 61 than the right end 71*b* in the horizontal-component direction E. Accordingly, it is possible to similarly move each of the sheets P discharged from the discharge opening 61 rightward in a simple structure.

As one modified example, the stopper 70 may be configured so as to be placed at a third position (a third posture) between the first position and the second position. That is, the third position of the stopper 70 is a position at which a prescribed angle θ3 is defined by the hitting surface 71 and the vertical plane L, as shown in FIG. 8. The angle θ3 is larger than the angle θ2 and is smaller than the angle θ1.

Referring to FIG. 8, there will be explained a movement of the sheet P discharged when the stopper 70 is placed at the third position.

Figures 8A, 8B, 8C, 8D:
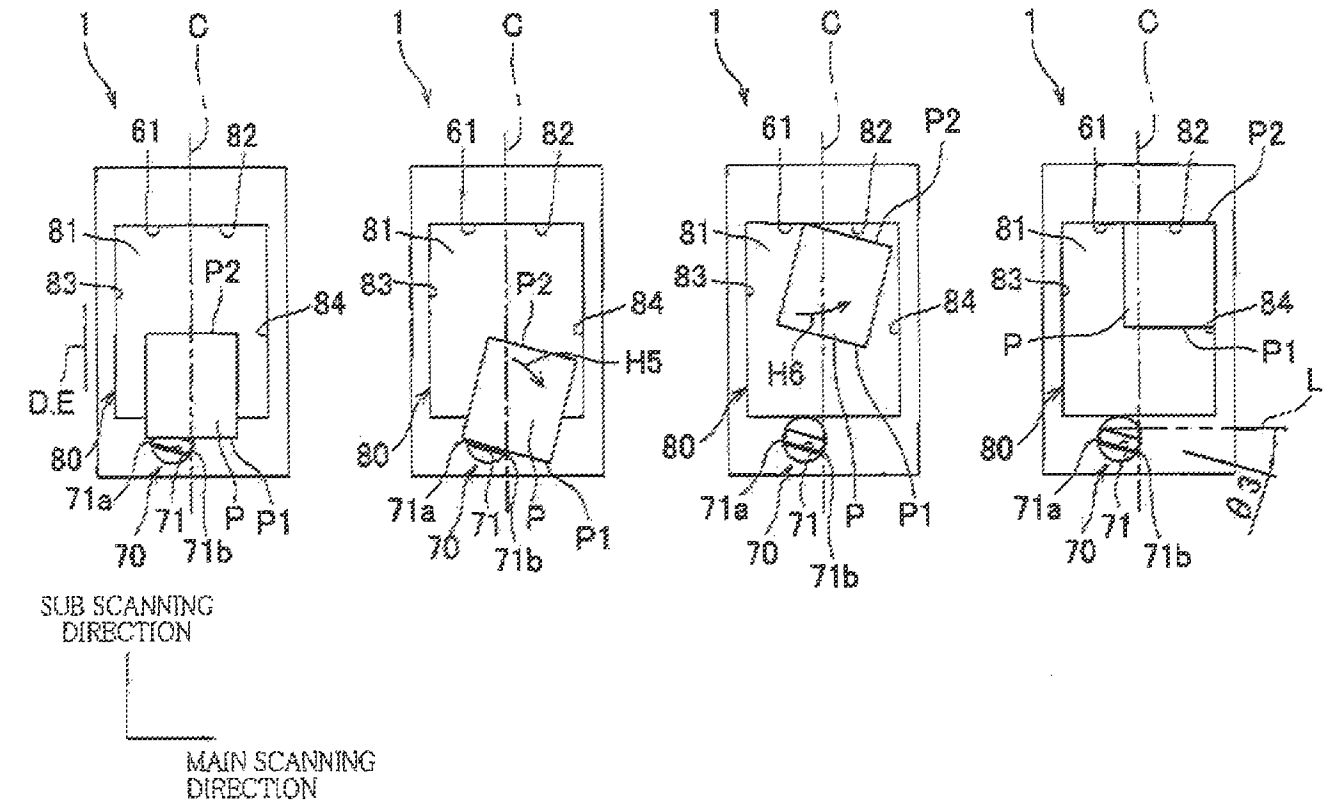
FIGS. 8A-8D show a movement of a sheet when discharged from the discharge opening in a state in which the stopper is placed at a third position, in an ink-jet printer according to one modified example of the embodiment.

As shown in FIG. 8A, when the sheet P is discharged from the discharge opening 61, the leading edge P1 of the sheet P hits on the stopper 70. In this instance, as in the case in which the stopper 70 is placed at the first position, the left-side portion, in the main scanning direction, of the leading edge P1 first hits on the left end 71*a* of the hitting surface 71. (The left-side portion of the leading edge P1 is located nearer to the left-side end of the sheet P than the center of the leading edge P1 in the main scanning direction.) Also in this instance, because the hitting surface 71 is inclined in the discharge direction D such that the upper end of the hitting surface 71 is away from the discharge opening 61, the leading edge P1 of the sheet P slightly moves in the discharge direction D along the hitting surface 71 while the speed of the movement of the sheet P in the discharge direction D is reduced, in other words, the momentum of the sheet P in the discharge direction D is weakened, due to the hitting on the stopper 70. As described above, the trailing edge P2 of the sheet P drops down in the movement, so that proper alignment of the sheets P is ensured. Further, in this instance, the sheet P rotates about a hitting point of the sheet P and the stopper 70 in a direction indicated by an arrow H5 in 8B due to the hitting of the sheet P and the hitting surface 71.

Subsequently, as shown in FIG. 8C, the sheet P slips down toward the wall portion 82 along the hitting surface 71 and the support surface 81. Because the sheet P has rotated in the direction H5, the sheet P slips down on the support surface 81 such that the right-side end of the trailing edge P2 gets closer to the wall portion 84. Thereafter, the sheet P moves such that the left-side end of the trailing edge P2 hits on the wall portion 82 before the right-side end of the trailing edge P2 hits on the wall portion 84. Due to the hitting, the sheet P rotates about a hitting point of the left-side end of the trailing edge P2 and the wall portion 82 in a direction indicated by an arrow H6 in FIG. 8C. As a result, the sheet P is stacked on the support surface 81 with the entirety of the right-side edge of the sheet P 1 kept in contact with the wall portion 84, as shown in FIG. 8D. Because the stopper 70 is placed at the third position as described above, the right-side end of the trailing edge P2 of the sheet P can be brought into contact with the wall portion 84 after the left-side end of the trailing edge P2 of the sheet P has contacted the all portion 82. Hence, all of the sheets P that have hit on the stopper 70 placed at the third position move toward the wall portion 84 to such an extent that the entirety of the right-side edge of each sheet P contacts the wall portion 84, resulting in proper alignment of the sheets P.

Figure 9:
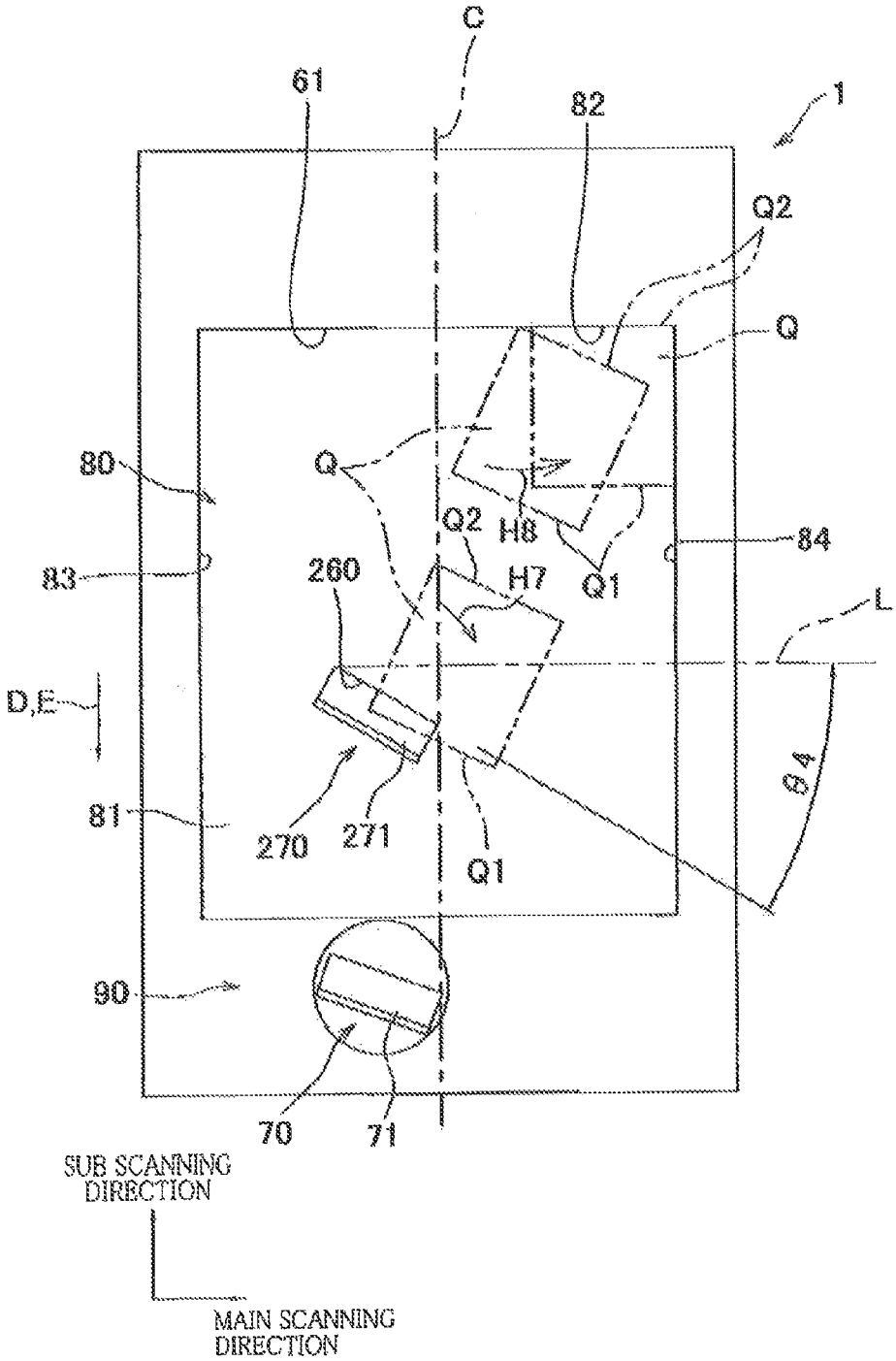
FIG. 9 is a plan view of an ink-jet printer according to another modified example of the embodiment.

As another modified example, another stopper 270 may be provided on the support surface 81 so as to have the same positional relationship as the stopper 70 with respect to the main scanning direction, as shown in FIG. 9. The stopper 270 is disposed between the stopper 70 and the discharge opening 61. The stopper 270 has a shape similar to that of the stopper 70, and its lower end portion is inserted in a hole 260 formed in the support surface 81 so as to extend upward. The stopper 270 is detachably inserted in the hole 260. Accordingly, the stopper 270 is removable when not necessary.

The stopper 270 has a hitting surface 271 similar to the hitting surface 71 described above. The stopper 270 is disposed such that an angle θ4 defined by the hitting surface 271 and the vertical plane L is larger than the above-indicated angle θ1, as viewed in the vertical direction, in other words, where the stopper 70 and the stopper 270 are projected on a plane orthogonal to the vertical direction. The hitting surface 271 is inclined toward the discharge direction D similarly to the hitting surface 71.

According to the thus structured stopper 270, even where a sheet Q whose size is smaller than that of the sheet P is discharged from the discharge opening 61, it is possible to ensure proper alignment of the sheets Q. Where the sheet size is small, the sheet Q discharged from the discharge opening 61 may slip down on the support surface 81 without coming into contact with the stopper 70. In view of this, the stopper 270 is disposed between the stopper 70 and the discharge opening 61, thereby permitting the discharged sheet Q to hit on the hitting surface 271 and to be subsequently stacked on the support surface 81.

When the sheet Q is discharged from the discharge opening 61, a leading edge Q1 of the sheet Q hits on the stopper 270, as shown in FIG. 9. In this instance, a left-side portion (as a one-side portion), in the main scanning direction, of the leading edge Q1 first hits on the hitting surface 271. The left-side portion of the leading edge Q1 is nearer to a left-side end (as a one-side end) of the sheet Q than the center of the leading edge Q1 in the main scanning direction. Also in this instance, because the hitting surface 271 is inclined in the discharge direction D such that the upper end of the hitting surface 71 is away from the discharge opening 61, the leading edge Q1 of the sheet Q slightly moves in the discharge direction D along the hitting surface 271 while the speed of the movement of the sheet Q in the discharge direction D is reduced, in other words, the momentum of the sheet Q in the discharge direction is weakened, by the hitting on the stopper 270. As in the case described above with respect to the sheet P, a trailing edge Q2 of the sheet Q drops down in the movement, so that proper alignment of the sheets Q is ensured with higher reliability. Further, in this instance, the sheet Q rotates about a hitting point of the sheet Q and the stopper 270 in a direction indicated by an arrow H7 in FIG. 9 due to the hitting of the sheet Q and the hitting surface 271. Therefore, even if the size of the sheet Q is small, the sheet Q moves largely toward the right side in FIG. 9.

Subsequently, the sheet Q slips down toward the wall portion 82 along the hitting surface 271 and the support surface 81, as shown in FIG. 9. In this instance, because the sheet P has rotated in the direction H7, the sheet Q slips down on the support surface 81 such that a right-side end of the trailing edge Q2 gets closer to the wall portion 84. Thereafter, the sheet Q moves such that a left-side end of the trailing edge Q2 hits on the wall portion 82 before the right-side end of the trailing edge Q2 hits on the wall portion 84. Due to the hitting, the sheet Q rotates about a hitting point of the left-side end of the trailing edge Q2 and the wall portion 82 in a direction indicated by an arrow H8 in FIG. 9. As a result, the sheet Q is stacked on the support surface 81 with the entirety of a right-side edge of the sheet Q kept in contact with the wall portion 84. Owing to the stopper 270 provided as described above, the right-side end of the trailing edge Q2 of the sheet Q can be brought into contact with the wall portion 84 after the left-side end of the trailing edge Q2 has contacted the wall portion 82. Hence, all of the sheets Q that have hit on the stopper 270 move toward the wall portion 84 to such an extent that the entirety of the right-side edge of each sheet Q contacts the wall portion 84, ensuring proper alignment of the sheets Q with higher reliability.

As a modification of the example of FIG. 9, the stopper 270 may be disposed such that an angle defined by the hitting surface 271 and the vertical plane L is larger than the angle θ4, and the right-side end of the trailing edge Q2 of the sheet Q that slips down on the support surface 81 after having hit on the hitting surface 271 may be brought into contact with the wall portion 84 at timing earlier than timing at which the left-side end thereof is brought into contact with the wall portion 82. The arrangement also ensures advantages similar to those obtained when the stopper 70 is placed at the first position in the illustrated embodiment.

As still another modified example, a plurality of stoppers may be provided at the other of the opposite ends, in the sub scanning direction, of the top plate of the housing 1*a*, so as to be arranged in the main scanning direction. For instance, where two stoppers are provided on the left side of the centerline C, an inner one of the two stoppers nearer to the centerline C may be disposed so as to be more distant from the discharge opening 61 in the horizontal-component direction E than an outer one of the two stoppers. In this arrangement, the outer stopper can ensure proper alignment of A4-size sheets and B5-size sheets while the inner stopper can ensure proper alignment of sheets with a business-card size and a postcard-size, for instance. In this case, the transfer-roller pairs may be controlled by the conveyance controller of the sheet-discharge controller such that the discharge speed of smaller-sized sheets is higher than that of larger-sized sheets. This arrangement enables the smaller-sized sheets to hit on the inner stopper.

Figure 10A:
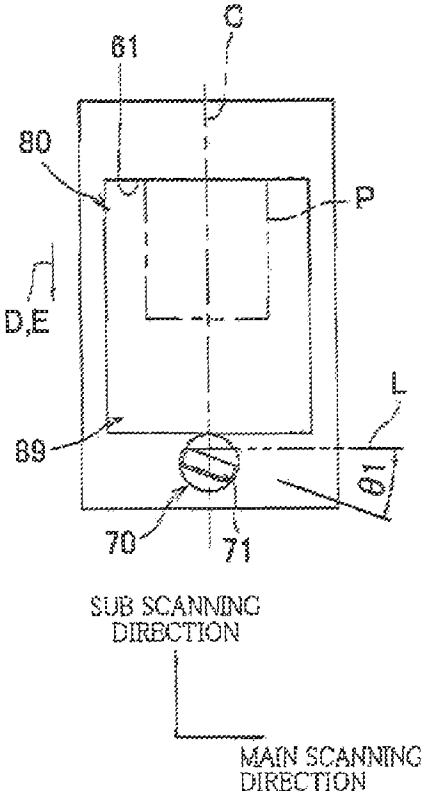
FIGS. 10A-10C are plan views of an ink jet printer according to still another modified example of the embodiment.
Figure 10B:
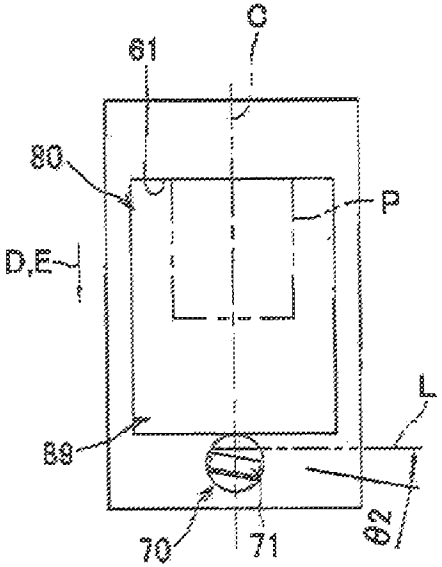
Figure 10C:
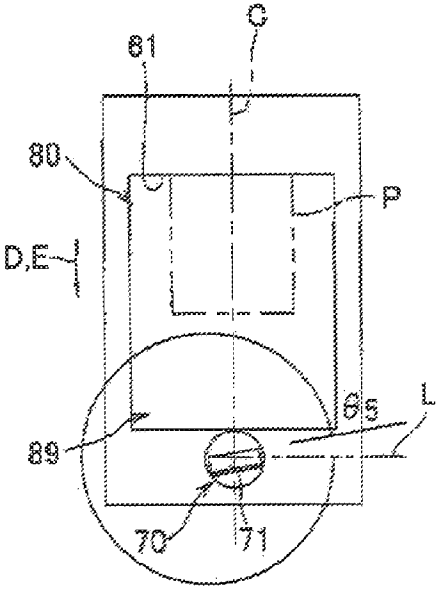

While the embodiment of the present invention and the modified examples thereof have been explained above, it is to be understood that the invention is not limited to the details of the illustrated embodiment and the modified examples, but may be embodied with various changes which may occur to those skilled in the art, without departing from the scope of the invention defined in the attached claims. For instance, the stopper 70 may be disposed on the centerline C of the discharged sheet in the main scanning direction, as shown in FIGS. 10A and 10B. Also in this instance, because the hitting surface 71 of the stopper 70 is inclined relative to the vertical plane L as viewed from above, the left-side portion in FIG. 10 of the leading edge of the sheet first hits on the stopper 70. The left-side portion (as the one-side portion) of the leading edge of the sheet is located nearer to the left-side end (as the one-side end) of the sheet than the center of the leading edge in the main scanning direction. In short, the stopper may be disposed at any position as long as the stopper enables the one-side portion of the leading edge of the sheet discharged from the discharge opening 61 to first hit on the stopper. In this instance, as shown in FIG. 10C, the stopper 70 may be rotated, namely, the hitting surface 71 may be rotated to a position at which the hitting surface 71 and the vertical plane L define a prescribed angle θ5, such that the right-side portion in FIG. 10 of the leading edge of the sheet first hits on the hitting surface 71, for thereby shifting the position, in the main scanning direction, of the sheet P discharged to the discharge tray 80. In this respect, like the stopper 70, the stopper 270 may also be disposed on the centerline of the discharged sheet in the main scanning direction.

It is not necessary for the stopper 70, 270 to have the flat hitting surface 71, 271. The stopper 70, 270 may have a partially flat hitting surface. For instance, the partially flat hitting surface may be formed by cutting a part of a cylindrical stopper. Further, the stopper may have a shape whose cross section is a circle, a triangle, or an n-sided polygon (n=a natural number not smaller than five).

Further, it is not necessary for the stopper to be inclined in the discharge direction D. In other words, the hitting surface (the hitting portion) on which the sheet hits may be formed so as to be parallel to the vertical direction or may be formed so as to be inclined in a direction opposite to the direction in which the hitting surface 71, 271 is inclined, in other words, the upper end portion of the hitting surface may be located nearer to the discharge opening 61 than the lower end portion in the horizontal-component direction E. Moreover, it is not necessary to provide the stopper pivoting mechanism 90. That is, the stopper may be fixed at a prescribed position such as the first position or the second position.

The present invention is applicable to serial-type ink-jet printers. Further, the present invention is applicable to not only printers, but also facsimile machines, copying machines, and so on. Moreover, the present invention is applicable to image recording apparatus configured to record an image on a sheet with a printing agent other than ink. Further, various kinds of recordable media other than the sheet P may be used.

In the illustrated embodiment, the control device 100 may be constituted by a single CPU, a plurality of CPUs, a specific application specific integrated circuit (ASIC), or a combination of the CPU and the specific ASIC.

What is claimed is:

1. A sheet-discharge device, comprising:

a sheet-discharge mechanism having a discharge opening and configured to discharge a sheet from the discharge opening in a discharge direction that intersects a vertical direction by permitting the sheet to fly;

a stopper having a hitting portion against which a leading edge, in the discharge direction, of the sheet discharged from the discharge opening hits, so that the sheet is bounced back;

a discharge tray having a support surface on which the sheet bounced back by the stopper is supported, the discharge tray being disposed, between the discharge opening and the stopper, at a height level in the vertical direction lower than a height level of the hitting portion of the stopper; and a sheet-discharge controller configured to control the sheet-discharge mechanism such that the sheet discharged from the discharge opening flies above the support surface, wherein the hitting portion is provided at a position at which a one-side portion of the leading edge of the sheet first hits the hitting portion, the one-side portion of the leading edge being nearer to a one-side end of the sheet than a center of the leading edge in an orthogonal direction that is parallel to a horizontal plane and that is orthogonal to the discharge direction.

2. The sheet-discharge device according to claim 1, wherein the discharge tray includes a first wall portion that extends upward from an end of the support surface located near to the discharge opening and a second wall portion that extends upward from an end of the support surface located near to an other-side end of the sheet in the orthogonal direction, the other-side end of the sheet being opposite to the one-side end of the sheet in the orthogonal direction, and wherein the stopper is provided such that a one-side end, in the orthogonal direction, of a trailing edge, in the discharge direction, of the sheet bounced back by the stopper first comes into contact with the first wall portion and thereafter an other-side end, in the orthogonal direction, of the trailing edge comes into contact with the second wall portion, the one-side end of the trailing edge of the sheet being located at the one-side end of the sheet, the one-side end and the other-side end of the trailing edge of the sheet being opposite to each other in the orthogonal direction.

3. The sheet-discharge device according to claim 1, wherein the discharge tray includes a first wall portion that extends upward from an end of the support surface located near to the discharge opening and a second wall portion that extends upward from au end of the support surface located near to an other-side end of the sheet in the orthogonal direction, the other-side end of the sheet being opposite to the one-side end of the sheet in the orthogonal direction, and wherein the stopper is provided such that a one-side end, in the orthogonal direction, of a trailing edge, in the discharge direction, of the sheet bounced back by the stopper comes into contact with the first wall portion after an other-side end, in the orthogonal direction, of the trailing edge has come into contact with the second wall portion, the one-side end of the trailing edge of the sheet being located at the one-side end of the sheet, the one-side end and the other-side end of the trailing edge of the sheet being opposite to each other in the orthogonal direction.

4. The sheet-discharge device according to claim 1, wherein the hitting portion has a flat hitting surface, and wherein the hitting surface is disposed on one of opposite sides of the stopper that is nearer to the discharge opening in a direction of a horizontal component of the discharge direction and the hitting surface is formed such that a one-side end, in the orthogonal direction, of the hitting surface that is near to the one-side end, in the orthogonal direction, of the sheet is located nearer to the discharge opening than an other-side end, in the orthogonal direction, of the hitting surface, the one-side end and the other-side end of the hitting surface being opposite to each other in the orthogonal direction.

5. The sheet-discharge device according to claim 4, wherein the hitting surface is inclined in the discharge direction relative to a vertical plane that is parallel to the orthogonal direction, such that a distance, in the direction of the horizontal component, between an upper end of the hitting surface and the discharge opening is larger than a distance, in the direction of the horizontal component, between a lower end of the hitting surface and the discharge opening.

6. The sheet-discharge device according to claim 4, further comprising another stopper having a hitting portion against which the leading edge, in the discharge direction, of the sheet discharged from the discharge opening hits, so that the sheet is bounced back, said another stopper being disposed at a position different from a position at which the stopper is disposed, wherein the hitting portion of said another stopper has a flat hitting surface against which the one-side portion of the leading edge of the sheet first hits, and wherein the hitting surface of said another stopper is provided such that an angle defined by the hitting surface of said another stopper and a vertical plane that is parallel to the orthogonal direction is larger than an angle defined by the hitting surface of the stopper and the vertical plane, where the stopper and said another stopper are projected on a plane orthogonal to the vertical direction.

7. The sheet-discharge device according to claim 4, further comprising a stopper pivoting mechanism configured to pivot the stopper such that the stopper is selectively placed at one of a first position at which the one-side end, in the orthogonal direction, of the hitting surface of the stopper is located, in the direction of the horizontal component of the discharge direction, nearer to the discharge opening than the other-side end, in the orthogonal direction, of the hitting surface of the stopper; and a second position at which the one-side end, in the orthogonal direction, of the hitting surface of the stopper is located more distant from the discharge opening than when the stopper is located at the first position.

8. An image recording apparatus, comprising:

the sheet-discharge device defined in claim 7;

a recording portion configured to record an image on the sheet based on a recording command before the sheet is discharged from the discharge opening by the sheet-discharge mechanism; and a stopper-pivoting controller configured to control the stopper pivoting mechanism to pivot the stopper from the first position to the second position or from the second position to the first position, such that, where a new recording command is received, at least one sheet on which an image has been recorded based on the new recording command is stacked on sheets already discharged to the discharge tray at a position different from a position of an uppermost one of the sheets.

* * * * *